US006993874B2

(12) United States Patent
Trout

(10) Patent No.: US 6,993,874 B2
(45) Date of Patent: Feb. 7, 2006

(54) JOINT MATERIALS AND CONFIGURATIONS

(75) Inventor: John T. Trout, 646 Hague Ave., St. Paul, MN (US) 55104

(73) Assignee: John T. Trout, St. Paul, MN (US)

( * ) Notice: Subject to any disclaimer, the term of this patent is extended or adjusted under 35 U.S.C. 154(b) by 54 days.

(21) Appl. No.: 10/226,581

(22) Filed: Aug. 23, 2002

(65) Prior Publication Data

US 2004/0035075 A1 Feb. 26, 2004

(51) Int. Cl.
*E04B 1/68* (2006.01)

(52) U.S. Cl. ..... 52/393; 52/396.04; 52/395; 52/402; 52/741.4

(58) Field of Classification Search ..... 52/396.04, 52/402, 393, 741.4, 395
See application file for complete search history.

(56) References Cited

U.S. PATENT DOCUMENTS

| | | | | | |
|---|---|---|---|---|---|
| 1,355,756 | A | | 10/1920 | Earley | |
| 1,701,629 | A | | 2/1929 | Pullar | |
| 1,800,609 | A | * | 4/1931 | Drake | 52/461 |
| 3,124,047 | A | * | 3/1964 | Graham | 404/47 |
| 3,330,187 | A | * | 7/1967 | Kohler et al. | 404/65 |
| 3,334,557 | A | * | 8/1967 | Fitzgibbon | 404/64 |
| 3,387,544 | A | * | 6/1968 | MacLellan et al. | 404/65 |
| 3,411,260 | A | * | 11/1968 | Dill | 52/396.03 |
| 3,667,174 | A | | 6/1972 | Arnett | |
| 3,782,846 | A | * | 1/1974 | Johnson | 404/48 |
| 3,807,107 | A | * | 4/1974 | Davis | 52/99 |
| 3,838,930 | A | * | 10/1974 | Koch | 404/48 |
| 4,067,155 | A | * | 1/1978 | Ruff et al. | 52/105 |
| 4,653,138 | A | * | 3/1987 | Carder | 16/4 |
| 4,824,283 | A | * | 4/1989 | Belangie | 404/64 |
| 4,952,104 | A | | 8/1990 | Osada | |
| 5,127,204 | A | | 7/1992 | Braun | |
| 5,155,952 | A | * | 10/1992 | Herwegh et al. | 52/100 |
| 5,335,466 | A | | 8/1994 | Langohr | |
| 5,671,571 | A | | 9/1997 | Braun | |
| 5,765,332 | A | * | 6/1998 | Landin et al. | 52/396.01 |
| 6,293,069 | B1 | | 9/2001 | Monda et al. | |
| 6,418,688 | B1 | * | 7/2002 | Jones, Jr. | 52/396.04 |
| 6,491,468 | B1 | * | 12/2002 | Hagen | 403/291 |

* cited by examiner

*Primary Examiner*—Basil Katcheves
(74) *Attorney, Agent, or Firm*—Vidas,Arrett& Steinkraus

(57) ABSTRACT

A method and apparatus for forming a sealed joint comprises a joint member having at least one elongate component that comprises a top surface, a bottom surface, a first component side and a second component side, wherein at least a portion of the top surface has a contour which is curved. In forming a joint a first member is formed on a substrate. The joint member is positioned against the first member and the substrate. A second member is formed on the substrate immediately adjacent to the joint member. In some embodiments the joint member comprises two components, one of which is removed following formation of the second member.

10 Claims, 9 Drawing Sheets

JOINT MATERIALS AND CONFIGURATIONS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

Various embodiments of the present invention are directed to systems for maintaining and/or at least partially filling a space between two materials, particularly materials such as concrete, brick, stucco, plastic, wood, metal, and other somewhat rigid materials associated with construction and manufacturing. In some embodiments the invention is directed to joints, such as expansion joints, and more specifically to backings, fillers, forms, stand-offs, spacers and other devices suitable for insertion into the space between materials to form a joint, hereinafter referred to cumulatively as a spacer or joint spacer. In those embodiments directed to a joint spacer, the spacer comprises one or more components that are configured for placement into and/or removal from a joint space.

2. Brief Description of Related Technology

Expansion joints and joints in general are present in many industrial applications. Typically a joint comprises a groove, trough or other space of selected shape and size between two surfaces or materials. Often the materials that define the space, such as concrete, wood, metal, plastic, etc. are often quite rigid. The space between these more rigid materials is at least partially filled with a joint spacer. The material of the joint spacer is typically less rigid than the surrounding materials. The joint spacer acts to maintain a space between the materials.

In many applications joint spaces are known to be formed by cutting into rigid materials or by forming the space through the utilization of rigid forming materials or standoffs. Once the joint space has been cut, or the forms removed, a flexible backer rod or other form is inserted into the space to a predetermined depth in order to obtain the desired joint shape and depth. After the backer rod is inserted, sealant is applied to finish the joint.

There are numerous disadvantages to cutting joint spaces in preparation for receiving a sealant. For example, in applications involving walls, it is difficult, if not impossible, to cut joint spaces adjacent to fenestrations or other wall penetrations in order to seal them to the surrounding material without damaging the frame or finish of the penetrating fixture in the cutting process. In addition, the cutting of joint spaces is expensive and difficult to do on vertical surfaces or from scaffolding. Furthermore, dust resulting from the cutting process may settle in the formed joint space. The dust may hinder sealant adhesion.

As mentioned above, as an alternative to cutting a joint space from the material, standoff type devices may be used to create the joint space. However, processes using forms and other standoff devices are also known to include drawbacks. For example, because standoffs are typically constructed of fairly rigid material that are put in place prior to the application of plastic construction materials, the forms often cannot be readily removed from the resulting joint space between the cured material without the destructive use of power tools or other equipment.

Often time standoffs are simply left in place within the joint space, however, because the standoff is made of rigid material that does not fill a substantial portion of the space, the standoff will not provide an insulating effect. Moreover, a standoff left in place may prevent the joint from opening and closing as intended, and may potentially lead to damage of the adjoining materials.

Known components that are inserted into the formed joint space, such as joint backer rods and other foam or semi-rigid materials are inserted into the joint space in order to establish a joint bottom and to provide a convex contour to the bottom of the joint space. As currently used however, backer rods and similar devices must be inserted into the joint space following placement of the materials adjacent to the space, or cutting of the space into the materials, but prior to the application of sealant. Almost without exception the backer rod or similar device is inserted into the space by the sealant contractor prior to application of the sealant. Often times during the insertion process the backer rod is punctured by the rough edges of the space or by the tools used to insert the rod. A punctured foam backer rod may emit gas causing bubbling in the plastic sealant. Another drawback to the use of backer rod is that it may be inserted at an inconsistent depth within the joint space. If this occurs, the joint sealant may fail prematurely because it was not placed at the desired depth to width ratio. In addition, expensive sealants may be wasted as a result of filling the joint space to a depth further than desired.

In light of the above, it is clear that a need exists to provide a joint formation process and joint insertion material which avoids the drawbacks associated with those previously utilized.

All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The present invention is directed to a variety of embodiments. In at least one embodiment, the invention is directed to one or more joint spacer components having at least one curved surface which is positioned to at least partially define the bottom of the joint space. At least one of the joint spacer components is constructed and arranged to be capable of expanding and contracting within the joint space.

In at least one embodiment the component is a substantially flexible, elongate member.

In at least one embodiment the component has a cross-sectional shape that is substantially flat on at least two sides, and curved on at least one side.

In some embodiments a plastic or flowable material such as preset terrazzo concrete or stucco at least partially defines the joint space. Where the joint space is defined by a plastic material the joint spacer is a member comprised of at least two components in a stacked configuration that are removably engaged to one another. Subsequent to the plastic material being made substantially rigid, the component positioned at the top or nearest to the opening of the joint space may be removed from the space. The lower or bottom component remains in place within the joint space. Alternatively, where the joint space is to be at least partially defined by rigid materials, such as wood, metal, synthetic or similar materials, the joint spacer may comprise a single component.

Where the joint spacer comprises a multi-component member the components are engaged to one another to form an elongated, sheet or member. In at least one method of use the member is constructed and arranged to be inserted within a joint space or to be position adjacent to a surface defined by a substantially rigid material.

Regardless of whether the joint spacer is inserted during or following the formation of a joint space, the joint spacer acts to define the joint space between two sections of material, such as concrete, wooden members, molding, etc. As the sections contract, expand, flex, and otherwise move as a result of changes in the environment such as temperature, humidity, etc., the space between the sections is maintained by the joint spacer. As a result the joint spacer is constructed to be capable of expanding and contracting to a substantial extent.

In some embodiments at least one side of the member is adhesively and removably engaged to at least one surface of a substantially rigid material. After the member is placed against a single surface of a substantially rigid first material a second material may be placed against the side of the member opposite the adhesively engaged side of the member. The member maintains a space between the materials. Where the member comprises multiple components, one or more top components of the member may then be removed from the bottom component and withdrawn from the joint space to complete the formation of the joint.

In at least one embodiment a sealant or other material may be placed over the component that remains within the joint space.

In at least one embodiment at least the bottom component defines a convex, surface that extends into the joint space.

In at least one embodiment the bottom component is constructed and arranged to provide the joint space with a width to depth ratio of about 2 to 1.

In at least one embodiment the height and width of the member may respectively range between about $1/8^{th}$ of an inch to about four inches or more.

In at least one embodiment of the invention, at least one of the components is constructed from closed and/or open cell foam.

In at least one embodiment the invention is directed to a building or structure such as a residential or commercial dwelling having a joints formed with a component and/or component members as described herein.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described a embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
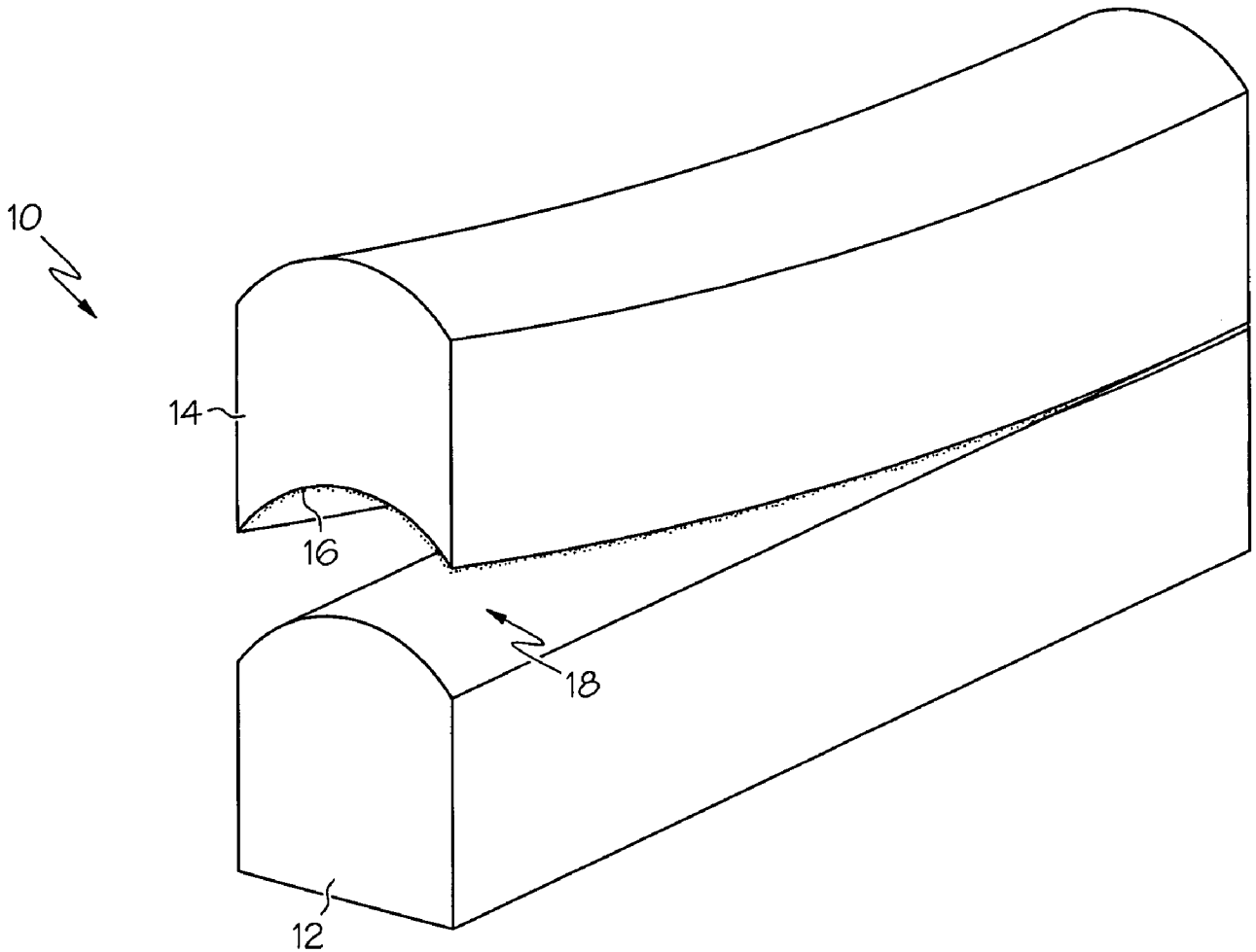
FIG. 1 is a perspective view of an embodiment of the invention.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

As indicated above, the present invention is directed to a variety of embodiments. A first embodiment is shown in FIG. 1 wherein a joint member, indicated generally at 10, is shown. Joint member 10 is comprised of at least one component 12, and in alternative embodiments is comprised of at least two components 12 and 14. Where the member 10 comprises more than one component the multiple components such as, components 12 and 14 are removably engaged to one another so that subsequent to the placement of the member 10 into a pre-existing joint space or the creation of a joint space with the use of member 10, the upper component 14 may be readily removed from the bottom component 12 without damaging the bottom component.

In the various embodiments described herein, the member 10 and any of its components, such as components 12 and 14, are capable of expanding and contracting when acted upon by an outside force. In some embodiments the components of member 10 are preferably light weight and flexible enough to be easily manipulated such as by being bent, folded to an angle of at least 90 degrees or more without damaging or detrimentally affecting the structure of the components 12 and 14 or member 10. Some examples of material suitable for use in manufacturing the member 10 and its components 12 and 14 are: foam, foam-rubber, and/or similar materials including but not limited to closed cell polyethylene foam and open cell polyurethane foam.

Foam and similar materials gain some of their desired characteristics by forming a matrix of cells. Often the cells of the foam contain various gasses. As is mentioned above, it is known that when foam is torn or otherwise disrupted, cells of the foam are ruptured and thus release any gas contained therein. In joint applications release of such gas may be particularly bothersome in that the released gas may interfere with the performance of the joint filler by forming bubbles in the sealant or other material placed upon the joint filler. Not only is the presence of bubbles in the sealant unsightly but the bubbles may also compromise the weatherproofing effectiveness of the sealant.

The present invention avoids potential gas release and its affects by avoiding the need to tear or cut the member 10 or its components 12 and 14 by removably engaging the components 12 and 14 through the use of an adhesive and/or mechanical engagement interface.

In the embodiment shown in FIG. 1, the bottom component 12 may be adhesively engaged to the upper component 14. Where an adhesive or other chemical 16 is used to engage the components, when the components 12 and 14 are separated, the adhesive or other coating is removed along with the upper component 14, leaving the exposed surface 18 of the bottom component 12 clean and free of debris. Suitable adhesives may include removable pressure sensitive adhesives including those that are both thermo-plastic and water based. A more specific example of an adhesive that may be suitable for use in the embodiment shown is described in U.S. Pat. No. 5,194,299, the entire content of which is incorporated herein by reference.

Figure 2:
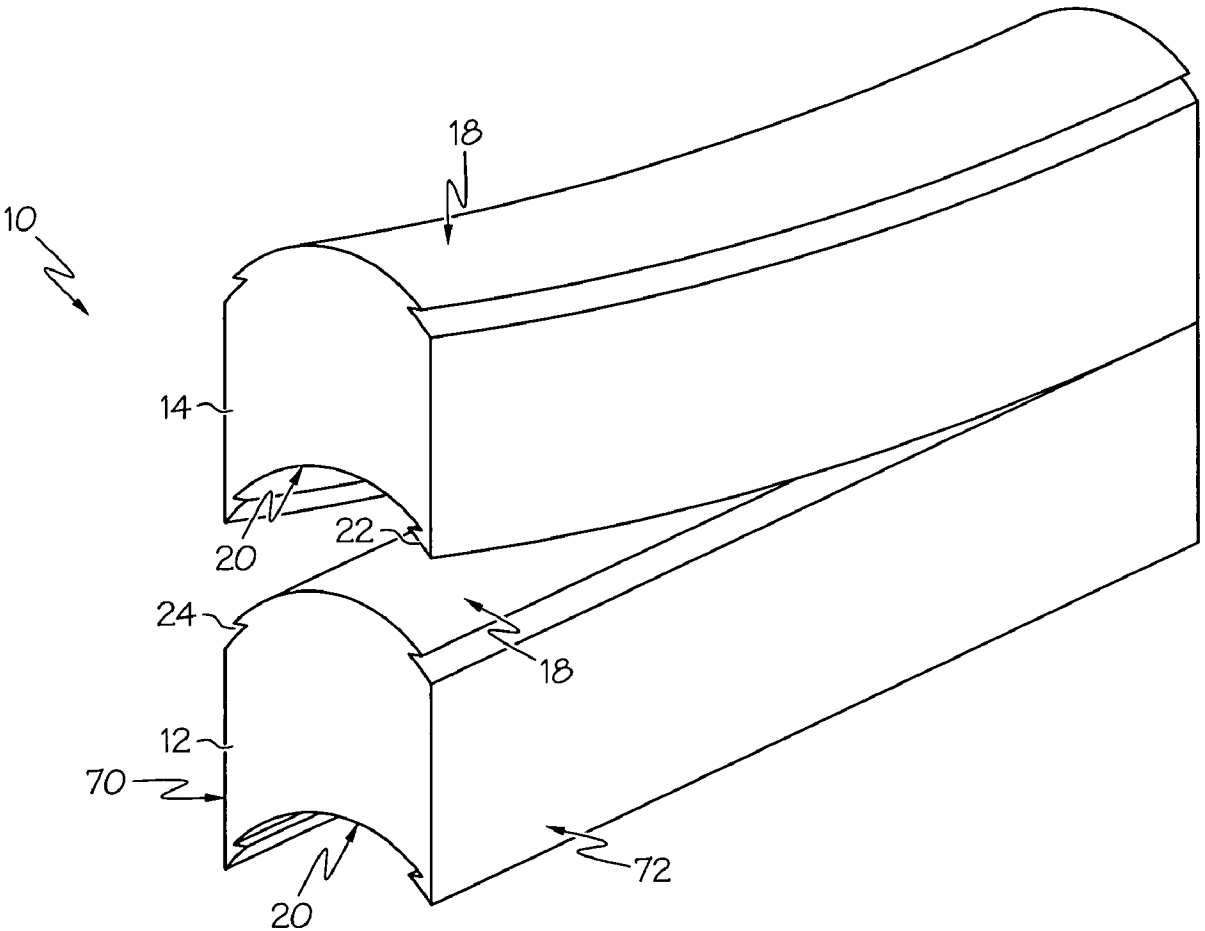
FIG. 2 is a perspective view of an embodiment of the invention.

In some embodiments of the invention, an example of which is shown in FIG. 2, the use of adhesives to engage the components 12 and 14 together prior to use may be avoided by providing the components 12 and 14 with complimentary surfaces 18 and 20 that engage one another by a mechanical interface.

In the example shown in FIG. 2, each component 12 and 14 have a first surface 18 and a second surface 20 which are removably engaged to adjacent surfaces by way of flange or lip 22 that is a shaped to correspondingly fit into groove 24. By providing each component 12 and 14 with the same corresponding features on the surfaces 18 and 20, a plurality of adjacent components may be stacked upon one another to provide a member 10 that may be comprised of two, three, four, five, or nearly any other number of components as may be required for a specific joint space. Because joint spaces may have a wide range of depths, a member 10 having multiple components allows a space to be filled to a desired depth in a highly efficient and inexpensive manner.

In the various embodiments of the invention, the surface of the component 12 be provided with a surface 18 that has an area that is greater than what a more substantially flat or planar surface would otherwise have. In the embodiments shown herein for example, sides 70 and 72 have substantially flat surfaces when compared to the convex shape of surface 18. The increased surface area of surface 18 provides for improved performance of the member 10 with sealants or other materials placed thereon. The convex surfaces 18 encourages sealants to bond to the material 34 surrounding the member 10 as is discussed in greater detail below.

The member 10 may be used in a variety of applications. In at least one embodiment member 10 is suitable for use as a joint filler as part of an joint or other construction application. In the embodiments shown, the member 10 has a size and shape to fittingly engage the sides of the joint space, and in some embodiments the bottom of the space as well. To this end, at least one component of the member 10, such as component 12, has a shape corresponding to the desired shape of the joint space.

Figure 3:
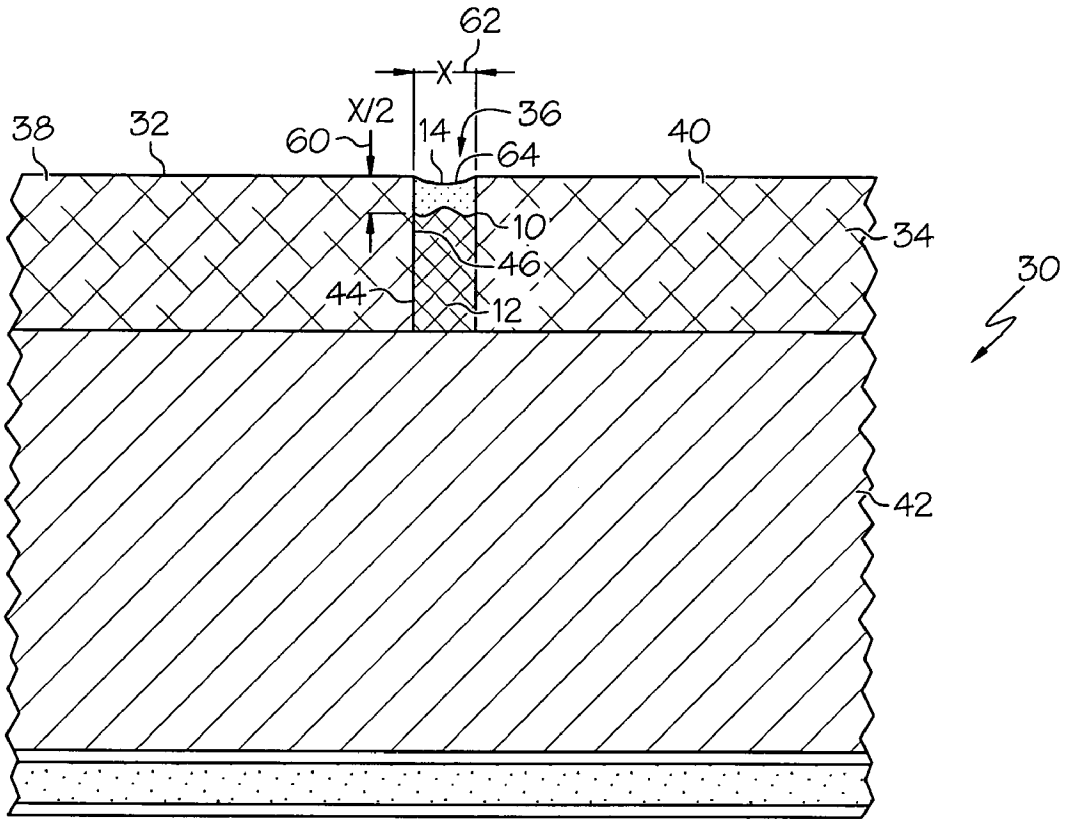
FIG. 3 is a schematic drawing of an embodiment of the invention as shown in an environment of use.
Figure 4:
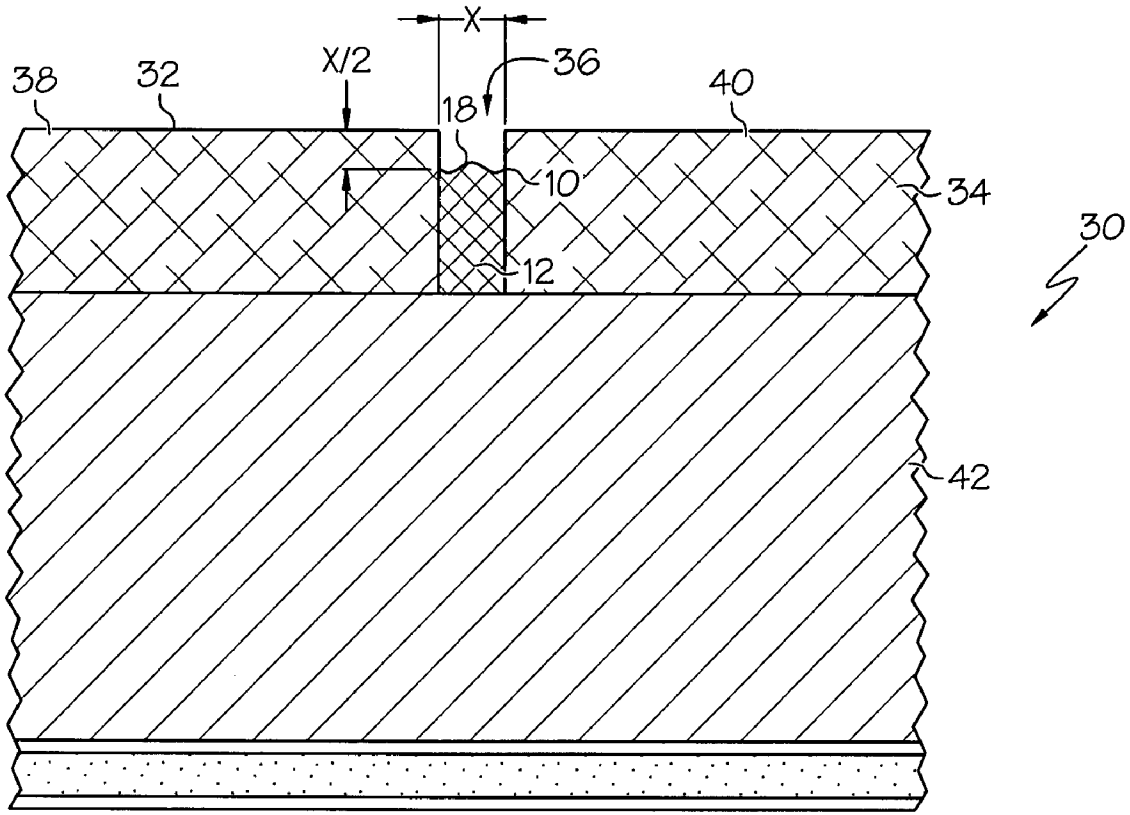
FIG. 4 is a schematic drawing of the embodiment shown in FIG. 3 after the removal of the top component.

An example of one type of joint and the manner it which member 10 may be utilized therewith is shown in FIGS. 3 and 4.

In FIG. 3 a wall or other form 30 has an exterior portion 32 constructed of concrete, stone, wood or other substantially rigid material 34. The material 34 defines one or more joint spaces 36 which separate sections 38 and 40 of the material 34.

In practice, after the first section 38 is put into place or otherwise formed upon the wall interior portion 42, the member 10 is placed against the surface 44 of the section 38 and the exposed wall interior portion 42.

To ensure that the member 10 is held in place against the section 38, the surface of the member 10 in contact with the section 38 may include an adhesive coating 46. In embodiments where member 10 is comprised of multiple components, the adhesive coating 46 may be present on one or both the upper component 14 and lower component 12. Where coating 46 is present on both components 12 and 14, the coating 46 may aid in retaining the upper component 14 to the lower component 12 prior to removal of the upper component 14. The adhesive 46 may be pressure sensitive to allow ready removal of the upper component 14 from the joint space 36 without drawing out the lower component 12.

Once the member 10 is positioned against the first section 38 the second section 40 is put into place. Where the second section 40 is a flowable material when initially put in to position adjacent to the member 10, the member 10 comprises at least two components such as components 12 and 14.

In some embodiments, sections 38 and 40 may already be present on wall 30. In this case a singe component member 10 may be inserted directly into the space 36 defined by the exterior sections 38 and 40. In such a case, the use of an adhesive 46 is not required as the frictional interface of the sections 38 and 40 against the member 10 may be sufficient to retain the member 10 within the space 36.

In a two component member 10, once the space 36 has been formed and member 10 is in place, the upper component is removed from the space 36, as is shown in FIG. 4. The lower component 12 remains within the space 36. Component 12 may be sufficiently water proof and/or weather resistant to be left in place without additional sealants or fillers. If desired however, a sealant or other material may be placed on top of surface 18.

Figure 5:
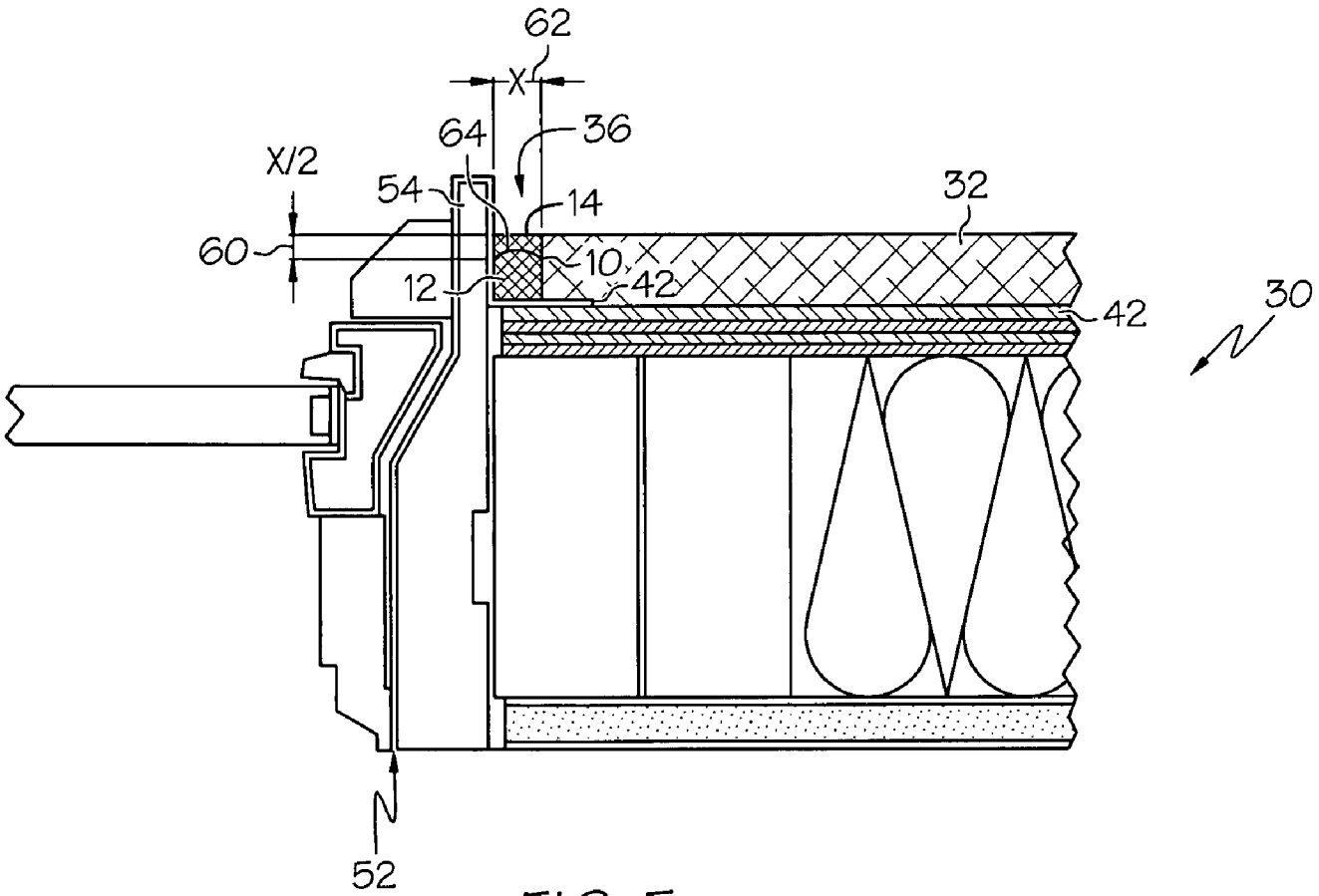
FIG. 5 is a schematic drawing of an embodiment of the invention as shown in an environment of use.
Figure 6:
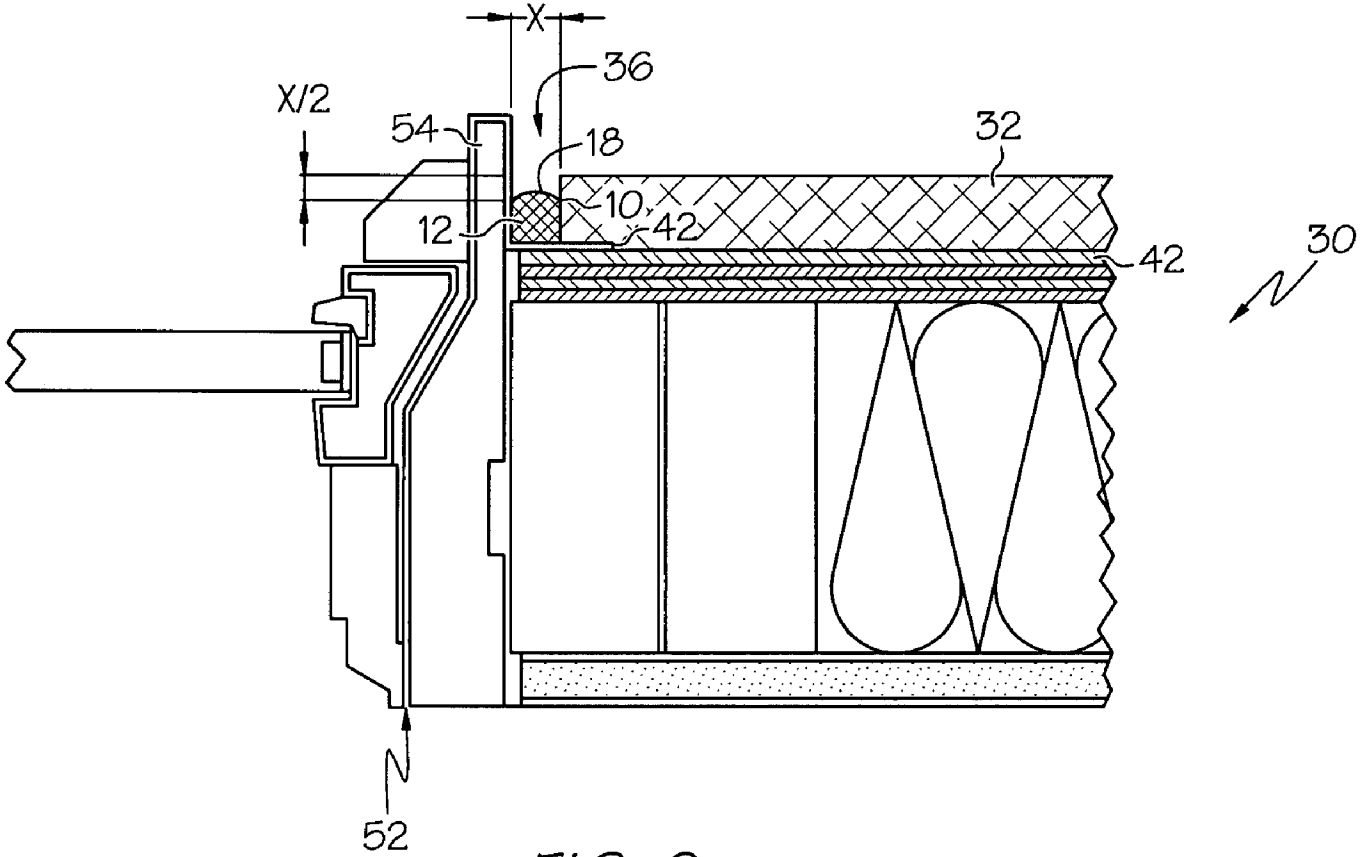
FIG. 6 is a schematic drawing of the embodiment shown in FIG. 5 after the removal of the top component.
Figure 7:
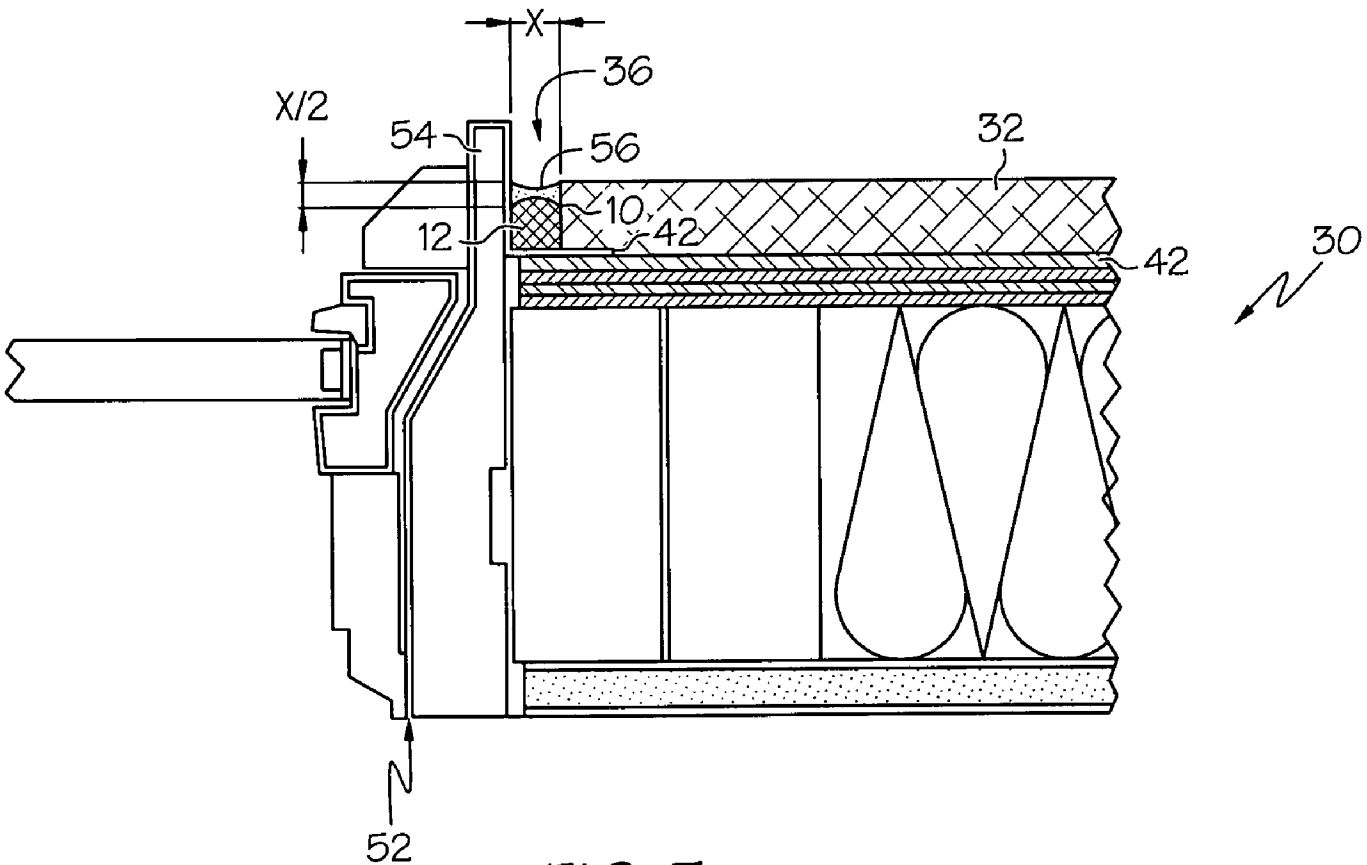
FIG. 7 is a schematic drawing of the embodiment shown in FIG. 6 after a sealant or other substance has been inserted into the joint space.
Figure 8:
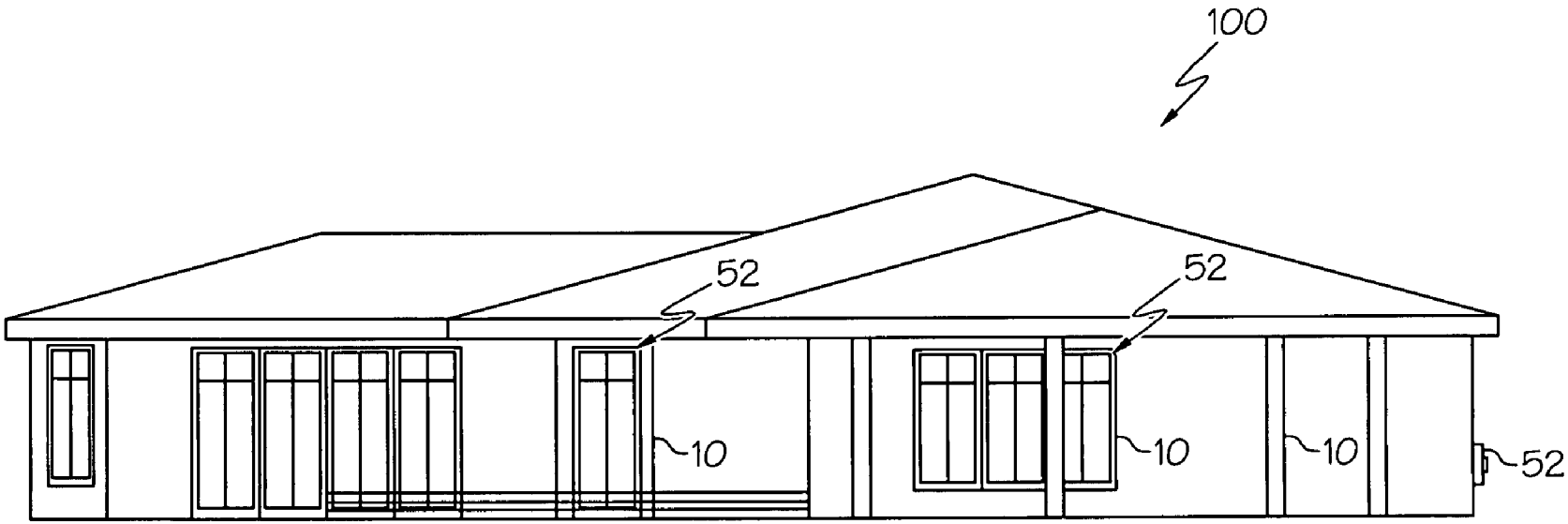
FIG. 8 is a perspective view of an embodiment of the invention.

In another embodiment, shown in FIGS. 5–7, the member 10 is shown as it may be used in the construction of a wall exterior finish adjacent to a window or other structure 52. Such an exterior finish, window, door, vents, or other structure 52, utilizing member 10 may be constructed within any commercial or residential dwelling such as building 100 shown in FIG. 8

In constructing a window 52 into a wall 30, the window frame 54 is put into place prior to completion or formation of the wall exterior 32. Where wall exterior 32 is stucco, concrete or other plastic material when initially applied, member 10 will be comprised of at least two components as described above. Where exterior 32 is a rigid member or members when applied, such as vinyl or wood siding, a member 10 comprised of a single component may be used. In FIG. 5 a member 10 is shown having an upper component 14 and a bottom component 12. FIG. 6 illustrates a member 10 shown comprised of only a single bottom component 12 while any upper component has been removed.

Once the window frame 54 is appropriately positioned and installed member 10 is placed against the frame 54 and the exposed wall interior or other complimentary surfaces 42. The exterior 32 is then put into place or completed leaving a joint space 36 within which member 10 is positioned.

Subsequently following completion of the wall exterior 32, the upper component of the member 10 is removed to expose surface 18 such as is shown in FIG. 6. A sealant 56 may then be placed over bottom component 12 to complete the formation of the joint, as is shown in FIG. 7.

Joints utilizing member 10 and/or joint formed according to the methods described herein are useful in many applications including but not limited to: the soundproof of walls; in ceiling and floor penetrations; in wall, ceiling and floor interfaces, both exterior and interior; in joints between rigid flooring materials such as tile, marble and terrazzo; in the production of door frames; in ventilation ducts, plumbing, conduit passages, and other penetrations of interior and/or exterior walls, floors and/or ceilings; in the formation of joints located at structural steel brick ledges used in constructing multi-story brick masonry facade structures, as well as others.

In some embodiments, such as in the examples shown in FIGS. 3 and 5, the upper component 14 corresponds to an area of the space 36 having a predetermined depth 60 and a predetermined width 62. This area 64, has a ratio of width to depth of approximately two to one (2:1).

It should be noted however, that while a 2:1 width to depth ratio is considered the optimum under the guide lines of the American Society for Testing Materials (ASTM), area 64 may be provided with any ratio desired.

Figure 9:
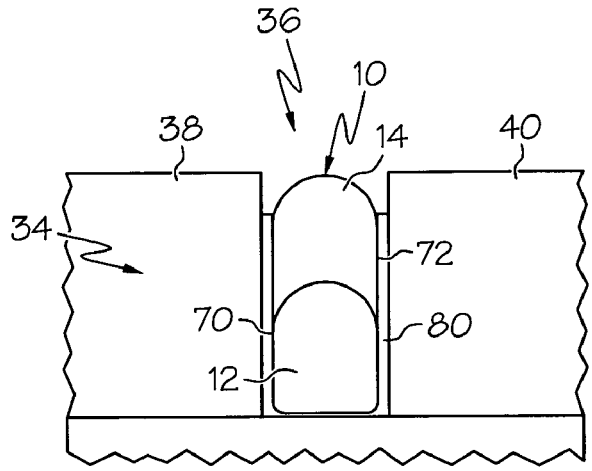
FIGS. 9–11 show an embodiment of the invention as used in the formation of a sealed joint.
Figure 10:
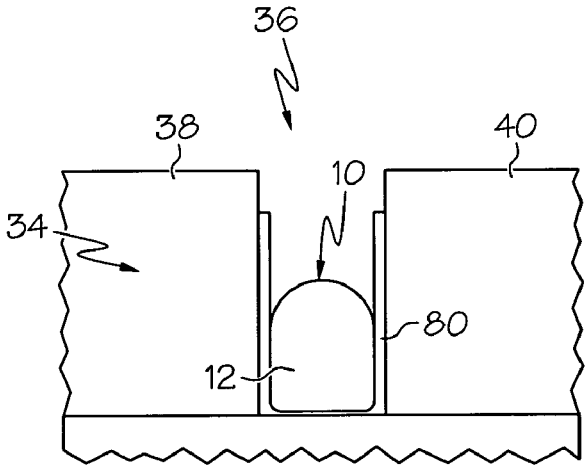
Figure 11:
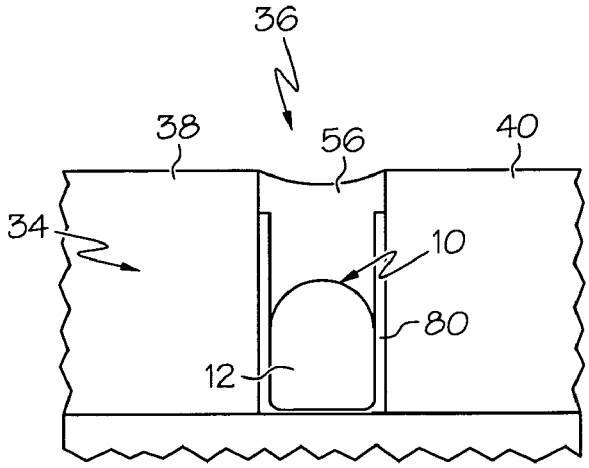

As indicated above, member 10 is particularly useful in encouraging a sealant 56 to bond with the material 34 of the joint walls 38 and 40 as opposed to the member 10 itself. In some embodiments such as are shown in FIGS. 9–11, the ability of the member 10 to encourage sealant bonding to the material 34 is further enhanced. In the embodiment shown the member 10 is provided with a bonding agent 80, which is at least partially transferred to the material 34 by the member 10. Bonding agent 80 is a layer of material such as a coating that is placed on the member 10 prior to placement of the member within the joint space 36.

Bonding agent 80 may be used in place of or in addition to an adhesive coating such as is described above. The bonding agent may be placed on any surface of the member 10 but is preferably placed on sides 70 and 72.

Preferably, the bonding agent 80 may be any sort of agent that encourages a sealant 56 to bond to the walls 38 and 40 of the material 34. In at least one embodiment the bonding agent 80 reacts with the moisture of the material 34 in the plastic state causing at least a portion of the bonding agent to adhere or migrate to the walls 38 and 40. As a result, when the upper component 14 is removed from the joint space 36, as is shown in FIG. 10, at least a portion of the bonding agent 80 remains in place, incorporated into the walls 38 and 40.

Such a bonding agent 80 may be any sort of moisture cure adhesive or coating. In some embodiments the bonding agent 80 includes one or more epoxy functionalities. In at least one embodiment the bonding agent 80 includes one or more bonding enhancers.

As is shown in FIG. 11, once the walls 38 and 40 solidify, the sealant 56 is applied to the joint space 36. The presence of the bonding agent 80 in the material 34 encourages the sealant to bond to the walls 38 and 40.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A joint member suitable for use in forming a sealed joint, the member comprising at least one elongate component, the at least one elongate component comprising a top surface, a bottom surface, a first side and a second side, at least a portion of the top surface defining a convex surface, at least a portion of the first side and at least a portion of the second side being substantially parallel to one another, the at least one elongate component comprising a first elongate component and a second elongate component, the bottom surface of the second component being removably engaged to the convex surface of the first component, the bottom surface of the second component and the top surface of the first component define a mechanical interface.

2. The joint member of claim 1 wherein the bottom surface of the second component defines at least one tab, and the top surface of the first component defines at least one groove, the at least one tab and the at least one groove constructed and arranged to be frictionally engaged one to the other.

3. A method of forming a joint comprising the steps of:

forming a first member on a substrate, the first member defining a first side of a joint space, the substrate defining the bottom of the joint space;

positioning a joint member against the first side of the joint space and the bottom of the joint space, the joint member comprising: at least one elongate component, the at least one elongate component comprising a top surface, a bottom surface, a first component side and a second component side, at least a portion of the top surface defining a convex surface, the first component side being substantially in contact with the first member, at least a portion of the bottom surface being in contact with the substrate, the at least one elongate component comprising a first elongate component and a second elongate component, the bottom surface of the second component being removably engaged to the top surface of the first component, the bottom surface of the second component and the top surface of the first component define a mechanical interface; and forming a second member on the substrate, the second member defining a second side of the joint space, the second component side being substantially in contact with the second member.

4. The method of claim 3 wherein the bottom surface of the second component defines at least one tab, and the top surface of the first component defines at least one groove, the at least one tab and the at least one groove constructed and arranged to be frictionally engaged one to the other.

5. The method of claim 3 wherein bottom surface of the second component and the top surface of the first component are adhesively and removably engaged to one another.

6. The method of claim 3 wherein the at least one component is at least partially constructed from at least one member of the group consisting of: foam-rubber, closed cell polyethylene foam, open cell polyurethane foam and any combination thereof.

7. The method of claim 3 further comprising a bonding agent, the bonding agent being positioned on at least a portion of at least one of the first side and the second side of the at least one elongate component.

8. The method of claim 3 further comprising the step of removing the second elongate component from the first elongate component after the second member is formed.

9. The method of claim 8 wherein the second member is at least partially plastic when formed on the substrate.

10. The method of claim 8 further comprising the step of placing a sealant on at least a portion of the top surface of the first elongate component after the second elongate component is removed.

* * * * *